US010052644B2

(12) United States Patent
Herre

(10) Patent No.: US 10,052,644 B2
(45) Date of Patent: Aug. 21, 2018

(54) COATING METHOD AND COATING SYSTEM HAVING DYNAMIC ADAPTATION OF THE ATOMIZER ROTATIONAL SPEED AND THE HIGH VOLTAGE

(75) Inventor: Frank Herre, Oberriexingen (DE)

(73) Assignee: Duerr Systems GmbH, Bietigheim-Bissingen (DE)

( * ) Notice: Subject to any disclaimer, the term of this patent is extended or adjusted under 35 U.S.C. 154(b) by 727 days.

(21) Appl. No.: 13/508,197

(22) PCT Filed: Nov. 2, 2010

(86) PCT No.: PCT/EP2010/006681
§ 371 (c)(1),
(2), (4) Date: May 4, 2012

(87) PCT Pub. No.: WO2011/054496
PCT Pub. Date: May 12, 2011

(65) Prior Publication Data

US 2012/0219700 A1 Aug. 30, 2012

(30) Foreign Application Priority Data

Nov. 4, 2009 (DE) ..... 10 2009 051 877

(51) Int. Cl.
*B05B 5/025* (2006.01)
*B05B 5/10* (2006.01)
(Continued)

(52) U.S. Cl.
CPC ..... *B05B 12/126* (2013.01); *B05B 5/0422* (2013.01); *B05B 5/0531* (2013.01);
(Continued)

(58) Field of Classification Search
USPC ..... 118/688, 620–640, 323; 700/109, 283; 901/9, 10, 43; 239/690–708
See application file for complete search history.

(56) References Cited

U.S. PATENT DOCUMENTS 3,892,357 A * 7/1975 Tamny ..... 118/629
4,266,262 A 5/1981 Haase, Jr.
(Continued)

FOREIGN PATENT DOCUMENTS

CN 1168645 A 12/1997
DE 10119521 A1 10/2002
(Continued)

OTHER PUBLICATIONS

International Search Report, PCT/EP2010/006681, dated Feb. 18, 2011.

*Primary Examiner* — Binu Thomas
(74) *Attorney, Agent, or Firm* — Bejin Bieneman PLC

(57) ABSTRACT

Exemplary coating methods and coating systems, e.g., for coating the component surface of a component with a coating agent by means of an atomizer in a coating system, for example to paint a body part of a motor vehicle with paint, are disclosed. An exemplary method comprises moving the atomizer over the component surface of the component to be coated, or moving the component in the spray jet, thereby applying the coating agent to the component surface by means of the atomizer. The atomizer may be operated with at least one electrical and/or kinematic operating variable comprising a certain voltage for the electrostatic charging of the coating agent and/or a certain rotational speed of a rotating spray element of the atomizer. In one example, the electrical and/or kinematic operating variable of the atomizer may be dynamically varied during the movement of the atomizer.

19 Claims, 6 Drawing Sheets

(51) Int. Cl.

| | |
|---|---|
| ***B05B 12/12*** | (2006.01) |
| ***B05B 5/04*** | (2006.01) |
| ***B05B 5/053*** | (2006.01) |
| *B05B 13/04* | (2006.01) |
| *B05B 12/08* | (2006.01) |
| *B05B 16/00* | (2018.01) |

(52) U.S. Cl.
CPC ..... *B05B 5/10* (2013.01); *B05B 12/122* (2013.01); *B05B 12/124* (2013.01); *B05B 5/0407* (2013.01); *B05B 5/0415* (2013.01); *B05B 5/0426* (2013.01); *B05B 12/082* (2013.01); *B05B 13/0431* (2013.01); *B05B 13/0452* (2013.01); *B05B 13/0457* (2013.01); *B05B 16/00* (2018.02)

(56) References Cited

U.S. PATENT DOCUMENTS

| | | | | | |
|---|---|---|---|---|---|
| 4,324,812 | A | * | 4/1982 | Bentley | 427/474 |
| 4,653,696 | A | * | 3/1987 | Rath et al. | 239/708 |
| 5,718,767 | A | * | 2/1998 | Crum et al. | 118/669 |
| 5,753,315 | A | * | 5/1998 | Minoura et al. | 427/475 |
| 5,814,375 | A | * | 9/1998 | Hissen | 118/323 |
| 5,992,771 | A | | 11/1999 | Noakes et al. | |
| 6,381,109 | B1 | | 4/2002 | Burtin et al. | |
| 2001/0020653 | A1 | * | 9/2001 | Wilson et al. | 239/690 |
| 2007/0157881 | A1 | * | 7/2007 | Yasuda et al. | 118/688 |
| 2009/0220703 | A1 | * | 9/2009 | Wohr et al. | 118/663 |
| 2010/0145516 | A1 | * | 6/2010 | Cedoz et al. | 700/258 |
| 2010/0147215 | A1 | * | 6/2010 | Baumann et al. | 118/621 |

FOREIGN PATENT DOCUMENTS

| | | | | |
|---|---|---|---|---|
| DE | 102006054786 | A1 | | 5/2008 |
| DE | 102007026041 | A1 | | 6/2008 |
| EP | 1245292 | A1 | | 10/2002 |
| EP | 1380353 | A1 | | 1/2004 |
| EP | 2085846 | | * | 8/2009 |
| EP | 2085846 | A2 | | 8/2009 |
| WO | WO-2005/042173 | A1 | | 5/2005 |
| WO | WO-2008/037456 | A1 | | 4/2008 |

* cited by examiner

COATING METHOD AND COATING SYSTEM HAVING DYNAMIC ADAPTATION OF THE ATOMIZER ROTATIONAL SPEED AND THE HIGH VOLTAGE

CROSS-REFERENCES TO RELATED APPLICATIONS

This application is a National Stage application which claims the benefit of International Application No. PCT/EP2010/006681 filed Nov. 2, 2010, which claims priority based on German Application No. DE 10 2009 051 877.0, filed Nov. 4, 2009, both of which are hereby incorporated by reference in their entireties.

BACKGROUND

The present disclosure relates to a coating method and a corresponding coating installation for coating components with a coating agent, e.g., for painting motor vehicle body parts with a paint.

In modern painting installations for painting motor vehicle body parts, multi-axis painting robots are generally used, which guide a rotary atomizer as an application unit. The painting robot guides the rotary atomizer over the component surface along programmed paths, the paths typically being placed in rows in a meandering manner. Alternatively, it is also possible for the component to be coated to be moved past the atomizer by means of suitable conveying technology or by a robot. In contrast to painting machines used previously (e.g. roof machines and lateral machines), painting robots of this type can track paths very flexibly. Furthermore, the use of painting robots means that the number of rotary atomizers can be greatly reduced, which leads however to higher demands on output per unit area and thus also on painting speed.

When the rotary atomizer is moved by the painting robot, the outflow quantity (i.e. the paint flow) and the guide air flow may be modified dynamically to achieve an optimal painting result. For example, only a little guide air, or no guide air at all, is applied if painting is desired over a wide area, for example when painting components of motor vehicle body parts with a large surface area (e.g. bonnet, roof area). During detailed painting, however, a relatively large guide air flow is output to constrict the spray jet.

In conventional painting installations, the rotational speed of the rotary atomizer and the high voltage of the electrostatic coating agent charging are generally kept constant by means of a regulation system. There was therefore no dynamic adaptation of rotational speed and high voltage during movement of the atomizer in the known painting installations, but merely dynamic adaptation of the fluidic operating variables such as paint flow and guide air flow. Although the high voltage of the electrostatic coating agent charging can also be changed in the known coating installations, this was not possible dynamically, but only between successive motor vehicle bodies.

A disadvantage of the conventional painting installations is therefore the unsatisfactory flexibility and dynamics when painting.

Accordingly, there is a need for a correspondingly improved painting installation.

BRIEF DESCRIPTION OF THE FIGURES

While the claims are not limited to the specific illustrations described herein, an appreciation of various aspects is best gained through a discussion of various examples thereof. Referring now to the drawings, illustrative examples are shown in detail. Although the drawings represent the exemplary illustrations, the drawings are not necessarily to scale and certain features may be exaggerated to better illustrate and explain an innovative aspect of an illustration. Further, the exemplary illustrations described herein are not intended to be exhaustive or otherwise limiting or restricting to the precise form and configuration shown in the drawings and disclosed in the following detailed description. Exemplary illustrations are described in detail by referring to the drawings as follows:

DETAILED DESCRIPTION

Figure 1A:
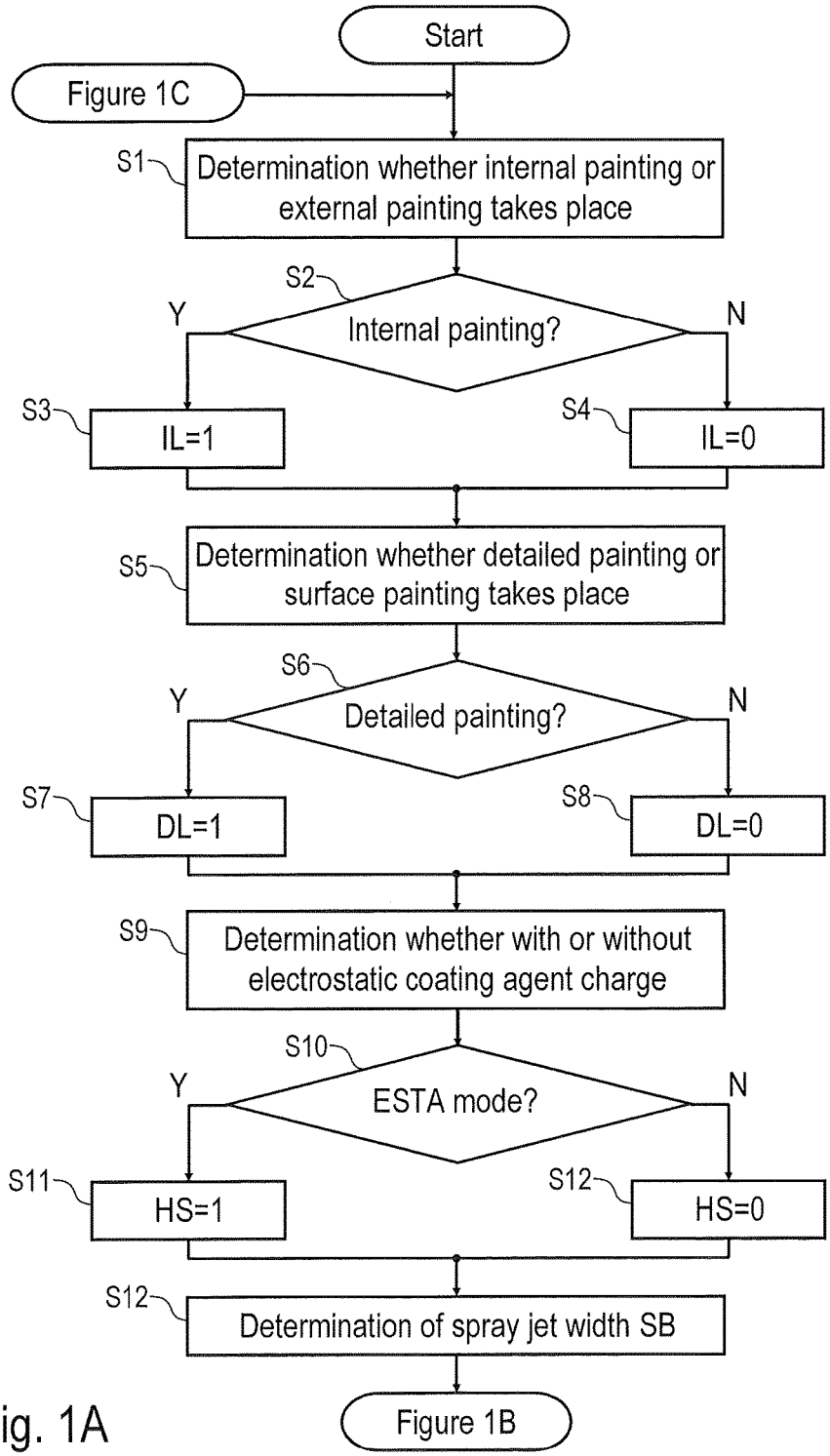
FIGS. 1A-1C illustrate an exemplary method for dynamic adaptation of the operating variables of the atomizer in the form of a flow chart.

The exemplary illustration include the technical finding that it is advantageous when operating a painting installation, if not only the fluidic operating variables (e.g. paint flow, guide air flow) are modified dynamically during movement of the atomizer, but also electrical and/or kinematic operating variables such as the rotational speed of the rotary atomizer or the high voltage with which the coating agent to be applied is electrostatically charged.

As already explained above, the dynamic change of the electrical and/or kinematic operating variables such as high voltage and/or rotational speed typically takes place during painting or coating, that is, inside the coating path predefined by the program control system of the coating installation, along which the rotary atomizer is usually moved over the component surface by the painting or coating robot during application. Path points, which may be predefined in any manner convenient, defined by the program control system for example using the teach method or in another manner, may be situated on said coating path, for which points the necessary operating variable sets (referred to as brush) can be set and changed in correspondence with the surface geometry of the component to be coated in each case. Therefore, according to the exemplary illustrations, said electrical and/or kinematic operating variables can also be changed in particular at these defined path points. Changes to other points related to the defined path points are also conceivable, for example when interpolating between adjacent path points.

Previously, it was not attempted for various reasons to modify the rotational speed and the high voltage dynamically as well during operation of the painting installation.

Firstly, conventional rotary atomizers are generally driven pneumatically by turbines, with which however the possible braking effect is much lower than the possible acceleration effect. It is therefore very difficult in terms of regulation to control the turbines in such a manner that the rotational speed of the rotary atomizer follows a certain rotational speed profile. Furthermore, the dynamics of the rotational speed of the rotary atomizer are influenced by numerous factors, such as the available air pressure for driving the turbine, the mass of the bell cup, which can vary depending on the material used (aluminium, steel or titanium), the diameter of the bell cup, the current quantity of paint to be applied, the viscosity and the solids content and the mass of the paint.

Secondly, dynamic changes in the electrostatic high voltage during operation of the painting installation were not previously considered, inter alia because such changes in voltage depend on the electrical capacitance of the coating agent charging, which is influenced by several factors which can change during operation. For example, the electrical capacitance can vary depending on the type of paint and the humidity. Furthermore, the high-voltage cascades used generally have a more or less great hysteresis, which previously likewise prevented dynamic modification of the high voltage during operation of the painting installation. The electrical capacitance of the painting installation changes depending on the application structures on the robot (e.g. 1C/2C, number of colours, number of rinsing agents, conductivity of the paint, hose cross section). Almost every installation therefore has different electrical capacitances, which must be increased and then reduced again by the high-voltage cascade. The inertia of the electrical operating variables however increases with the electrical capacitance of the painting installation. It is therefore difficult to predict the behaviour of the installation and thus to simulate the painting results. In conventional painting installations, attempts have previously been made to keep the electrical operating variables constant.

The exemplary illustrations generally provide for the first time for the rotational speed of the rotary atomizer and/or the high voltage of the electrostatic coating agent charging to be dynamically adapted during operation of a coating installation, i.e. during the movement of the atomizer along the predefined painting path. This should be distinguished from a virtually static modification of the rotational speed and/or high voltage between successive painting processes. The term "dynamic modification" used in the context of the exemplary illustrations may therefore mean that the electrical and/or kinematic operating variables (e.g. rotational speed, high voltage) is changed within a painting path. Furthermore, it is also possible within the context of the exemplary illustrations for further operating variables (e.g. guide air flow, paint flow, outflow quantity, robot speed) of the atomizer or painting installation to be dynamically modified, such as fluidic operating variables.

One advantage of the exemplary illustrations consists in the higher dynamics, as a result of which faster painting is made possible, which in turn leads to shorter cycle times and thus reduces the cost per unit (CPU) during painting.

A further advantage of the exemplary illustrations consists in the improved painting result and higher paint quality.

Furthermore, the dynamic adaptation of electrical operating variables (e.g. high voltage) may make it possible to reduce the number of high voltage flashovers, as a result of which fewer operating faults occur, which in turn improves what is known as the first run rate, i.e. the fault rate during the first run of the painting installation.

The exemplary illustrations also advantageously make it possible to save air and thus reduce costs per unit (CPU) during painting.

In one exemplary illustration, the dynamics of the modification of the electrical and/or kinematic operating variables (e.g. rotational speed, high voltage) and/or the fluidic operating variables (e.g. paint flow, guide air flow) of the atomizer are so great that when the setpoint value is changed the setting time is less than 2 s, 1 s, 500 ms, 300 ms, 150 ms, 100 ms, 50 ms, 30 ms or even less than 10 ms. The setting time is in this case the time span necessary for a change in setpoint value, to implement at least 95% of the setpoint value change.

The term "electrical and/or kinematic operating variable" used in the context of the exemplary illustrations may mean the rotational speed of the rotary atomizer and the high voltage of an electrostatic coating agent charging. It is possible within the context of the exemplary illustrations that only the rotational speed is modified dynamically, while the high voltage is set in a conventional manner. It is furthermore possible that only the high voltage is modified dynamically, while the rotational speed is set in a conventional manner. However, both the rotational speed and the high voltage may be changed dynamically. Furthermore, it should be mentioned that the term "electrical and/or kinematic operating variable" used in the context of the exemplary illustrations is not limited to the rotational speed of the rotary atomizer and the high voltage of the electrostatic coating agent charging, but also includes other electrical or kinematic operating variables of the atomizer or painting installation. For example, it is also possible within the context of the exemplary illustrations that the electrical current of the electrostatic coating agent charging is modified dynamically, which is advantageous in particular if the coating agent is charged using an external charging system, i.e. by means of externally situated electrodes.

Furthermore, the term "fluidic operating variable" used in the context of the exemplary illustrations may mean the paint flow and the guide air flow; in the case of a plurality of separate guide air flows, it is possible for these to be dynamically adapted independently of each other. The term "fluidic operating variable" used in the context of the exemplary illustrations is however not limited to the guide air flow and the paint flow, but in principle also includes other fluidic operating variables of the atomizer or painting installation.

One concept explained herein regarding the exemplary illustrations is that, due to the additional dynamics in the rotational speed and high voltage regulation, the operating variables are no longer kept as constant as possible as in the prior art, but can be parameterised in a highly dynamic manner when changing brushes (previously outflow quantity and guide airs) for optimum painting e.g. of inner areas, but also of outer areas and detailed areas.

The control system may be, in one example, so intelligent owing to painting rules and data arrays that it is capable of changing the correct parameters automatically in order to adapt optimally to the location to be painted. An acceptable quality should be achieved in the process, with extremely high efficiency and painting speed. It is however also conceivable that the order of the optimisation priorities can be specified for the control system. Then, priority could be given to the shortest painting time, highest efficiency, lowest paint consumption, lowest outflow quantity, conservation of the robot (least dynamic movement of the robot possible), lowest high voltage flashover risk, best layer thickness distribution, lowest paint fault risk (runs, bubbles), control of the wetness of the paint, colour etc.

In one example, a status variable of the coating installation is determined continuously during the movement of the atomizer, it being possible for example for the status variable to reproduce the geometry of the component surface at the impact point of the paint. This status variable is then used for dynamic adaptation of the electrical and/or kinematic operating variable and/or fluidic operating variable. This means that the electrical and/or kinematic operating variable and/or fluidic operating variable are changed depending on the determined status variable in order to optimise the coating result.

Within the context of the exemplary illustrations, the status variable can be determined for example by a measurement. It is however also possible that the status variable of interest is present anyway as a control variable in a control unit as an actuating variable and then only has to be read out.

For example, the status variable taken into account in the dynamic adaptation of the electrical and/or kinematic operating variable and/or the fluidic operating variable can reproduce the geometry of the component at the impact point of the paint, as already mentioned briefly above. So, when painting essentially flat component surfaces which have a large surface area, a spray jet which is spread out wide may be desirable in order to achieve a large output per unit area, so the guide air is then expediently shut off. Furthermore, a relatively large paint flow can then be selected in order to allow a correspondingly large output per unit area, it then only being possible for the large paint flow to be applied with a correspondingly high rotational speed of the rotary atomizer. Furthermore, when painting essentially flat component surfaces which have a large surface area, the high voltage can be selected to be relatively high, as the risk of electrical flashovers is then relatively low. When painting very curved component surfaces, however, a relatively constricted spray jet may be desirable so that a relatively large guide air flow is selected. Furthermore, the high voltage of the coating agent charging should then be relatively low in order to avoid electrical flashovers.

It is also possible for the status variable taken into account during dynamic adaptation of the operating variables to state whether internal or external painting is taking place. During internal painting of an inner space of a motor vehicle body part, a greatly constricted spray jet is thus generally desirable, whereas during external painting of outer surfaces of a motor vehicle body part a relatively spread out spray jet is generally desirable, which results in correspondingly different demands on the guide air flow. Furthermore, internal painting and external painting also differ in the demands on the high voltage of the coating agent charging, as for example a relatively low high voltage is possible in any case in an inner space in order to avoid flashovers.

It is also possible within the context of the exemplary illustrations for the status variables taken into account in the dynamic adaptation of the operating variables to state whether painting should take place currently with or without electrostatic charging of the coating agent.

A further possibility consists in that the status variable reproduces the distance between the paint impact point and an electrical earthing or grounding point at which the component to be painted is earthed or grounded. When painting plastic parts (e.g. bumpers), geometry and dynamics are thus likewise of critical importance, as paint is applied partly to electrically grounded components and partly to electrically insulated components, which are however fixed with steel holders. The electrical current of the electrostatic coating agent charging is then directed via the wet paint to a grounding point connected to the component. The insulation or the proximity to the grounding point must be taken into account at each different point of the geometry, so dynamic adaptation of the high voltage depending on the distance from the grounding point is advantageous.

It is also possible within the context of the exemplary illustrations for the status variable taken into account in the dynamic adaptation of the operating variables to state whether the respective component is a plastic component or a component consisting of an electrically conductive material, which results in the above-mentioned advantages.

It is also possible for the status variable taken into account during dynamic adaptation of the operating variables to state whether detailed painting or surface painting is currently taking place. There are different demands on paint flow, guide air flow, rotational speed and high voltage of the coating agent charging during detailed painting on the one hand and surface painting on the other.

The status variable taken into account in the dynamic adaptation of the operating variables can also reproduce whether the atomizer is currently being cleaned or whether the atomizer is being used to apply paint. There are different demands on paint flow, guide air flow, rotational speed and high voltage of the coating agent charging during cleaning of the atomizer on the one hand and using the atomizer to apply paint on the other.

The above-mentioned examples for the status variable can also be combined with each other within the scope of the exemplary illustrations. For example, the operating variables can be adapted dynamically depending on a plurality of the status variables mentioned above by way of example. Furthermore, the exemplary illustrations are not limited to the above-mentioned examples with respect to the status variables taken into account for the dynamic adaptation, but can also be realised with other status variables.

Furthermore, it is also possible within the scope of the exemplary illustrations for the operating variables to be adapted automatically using software. For example, an operating variable (e.g. spray jet width) can be changed, whereupon the other operating variables (e.g. guide air, paint flow, painting speed, high voltage, rotational speed) can then follow.

In a first example of such an automatic adaptation of parameters, a geometric factor is determined continuously during the movement of the atomizer, which reproduces the geometry of the component surface at the paint impact point. The spray jet width is then adapted depending on this geometric factor, which in turn leads to a corresponding adaptation of guide air flow, paint flow and/or painting speed (i.e. movement speed of the atomizer).

In a second example of the automatic adaptation of parameters, the high voltage is modified on the painting path on the basis of the respective shape of the component during internal painting, which automatically leads to corresponding adaptation of the paint flow (outflow quantity).

The adaptation of the parameters or operating variables which may take place in the two examples mentioned above by way of example can take place using software or a control program, merely as examples. It is however also possible for the control program merely to make an adaptation suggestion, which can then be implemented by a programmer (teacher) or installation operator.

The high voltage for the electrostatic coating agent charging may be generated by means of a high-voltage cascade, rapid reduction of the high voltage being possible by connecting the high-voltage cascade to earth directly by means of a bleeder switch or a ground switch or via a bleeder resistor. Any high voltage generator may be employed that is convenient, e.g., of the cascade type for electrostatic coating installations described in U.S. Pat. No. 6,381,109, U.S. Pat. No. 4,266,262, etc.) and may essentially contain a multi-stage high-voltage cascade, which is connected downstream of a high voltage transformer and the stages of which consist of diodes and capacitors. A particularly expedient possibility for extremely fast, virtually delay-free modification of the high voltage consists in replacing the diodes of conventional cascades with high-voltage-resistant photodiodes which can be controlled by light and by the light control of which the cascade and expediently each individual cascade stage can be switched on or off or controlled in terms of current in order to change the high voltage.

It is furthermore possible within the scope of the exemplary illustrations for the rotary atomizer to be driven by an electric motor, e.g., as described in WO 2008/037456 and corresponding U.S. Pat. Pub. No. 2010/0147215A1, in order to make a high level of rotational speed dynamics possible.

Alternatively, it is also possible for the rotary atomizer to be driven hydraulically in order to make the necessary rotational speed dynamics possible.

In this case an electrical potential isolation can additionally be provided on the rotary atomizer in order to allow an electrostatic coating agent charging despite the electrical or hydraulic drive of a rotary atomizer at high voltage potential during operation. Possibilities for this are described in the WO document and corresponding U.S. Pat. Pub. No. 2010/0147215A1 mentioned above.

The rotary atomizer may be driven in any manner that is convenient, e.g., pneumatically by a turbine. The turbine may be not only accelerated by means of compressed air but also actively braked by means of compressed air in order to achieve the necessary rotational speed dynamics. It can be expedient for this e.g. to supply the turbine wheel of the drive turbine with additional driving or braking medium (e.g. air) via one or a plurality of additional supply channels which can be switched on and off in order to accelerate desirable positive or negative rotational speed changes, e.g., as is provided by EP 1 245 292 B1.

It should furthermore be mentioned that the exemplary illustrations make it possible for the first time for the electrical and/or kinematic operating variables (e.g. rotational speed, high voltage) of the atomizer to be changed synchronously with the fluidic operating variables (e.g. guide air flow, paint flow). This means that these various operating variables react synchronously to a change in setpoint value.

It should further be mentioned that the term "movement of the atomizer" used in the context of the exemplary illustrations can have different meanings One meaning of this term provides for the component to be coated to be stationary while the atomizer is moved over the component surface of the stationary component. Another meaning of this term provides for the atomizer to be stationary while the component with the component surface to be coated is moved along the atomizer. A third meaning of this term provides for both the atomizer and the component to be coated to be moved during coating and thereby execute a relative movement.

It should finally be mentioned that the exemplary illustrations also include a correspondingly adapted coating installation which is suitable for dynamic adaptation of the electrical/kinematic operating variables (e.g. rotational speed, high voltage).

Figure 1B:
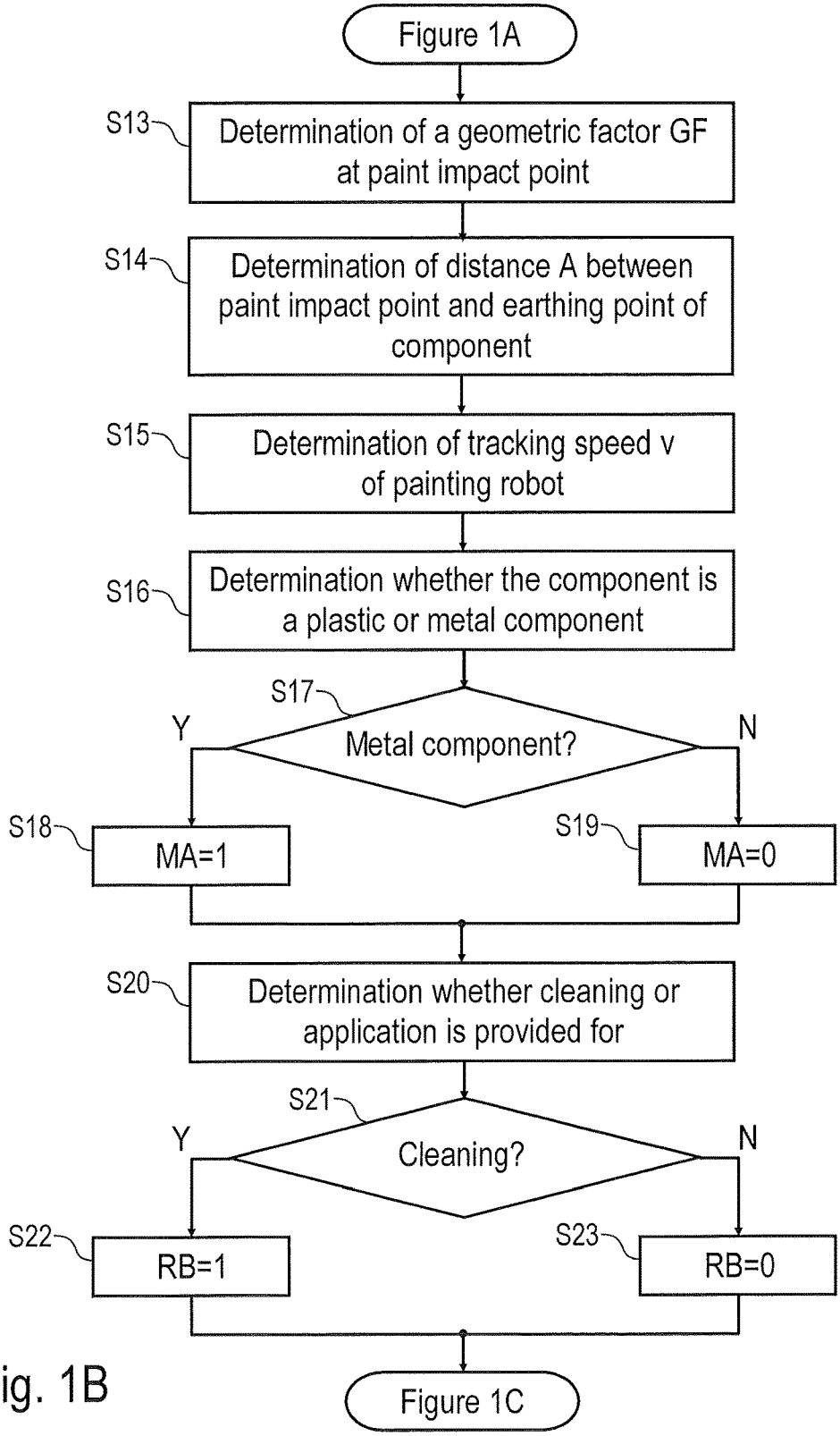
Figure 1C:
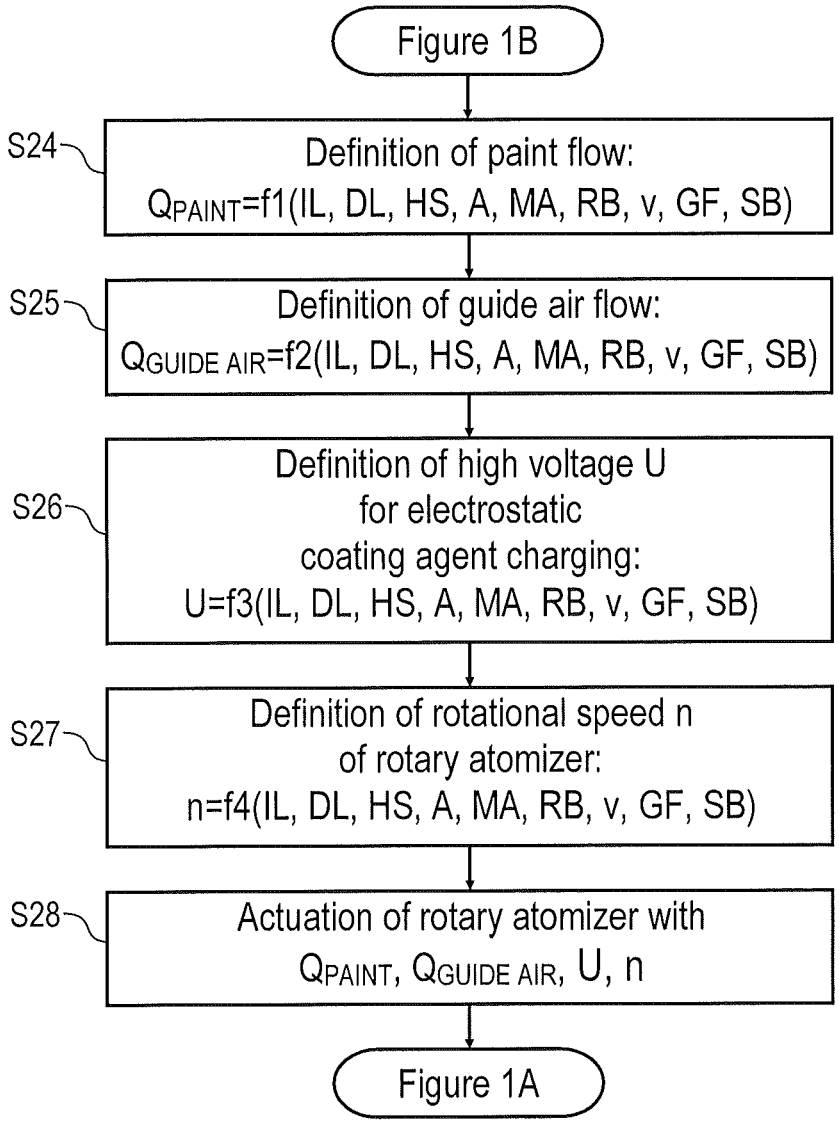

FIGS. 1A-1C show exemplary method steps according to the exemplary illustrations of a coating method in the form of a flow chart. In this exemplary illustration, the coating method may be used for painting motor vehicle body parts in a painting installation, the painting taking place with rotary atomizers which are each guided by a multi-axis painting robot. It should furthermore be mentioned that the method steps described in more detail below may be repeated continuously during painting operation in order to allow dynamic adaptation of the operating variables of the rotary atomizer.

At block S1, it may be first determined whether internal painting of an inner space of a motor vehicle body part or external painting of outer surfaces of the motor vehicle body part is taking place. This difference is important because different demands are made of the operating variables (e.g. guide air flow, high voltage) of the rotary atomizer for internal painting on the one hand and external painting on the other hand. For instance, a spray jet which is spread out wide is generally sensible for external painting in order to be able to paint over as wide an area as possible. In contrast, a relatively constricted spray jet is desirable for internal painting in order to be able to paint details more precisely.

In a next block S2 a branch is made either to a block S3 or a block S4, depending on the type of painting (internal painting or external painting).

In the case of internal painting, a corresponding flag IL=1 may be set in block S3.

In the case of external painting, the flag IL may be deleted at block S4, IL=0. The flag IL therefore states whether internal painting or external painting is to be carried out, so the flag IL is then stored for subsequent inclusion in the dynamic adaptation of the operating variables (e.g. guide air flow, paint flow, rotational speed, high voltage) of the rotary atomizer.

It is then determined at block S5 whether detailed painting or surface painting is to take place. This difference is likewise important because different demands are made of the spray jet for detailed painting on the one hand and surface painting on the other. For instance, a greatly constricted spray jet is desirable for detailed painting, whereas a spray jet which is greatly spread out is the aim for surface painting, which is associated with correspondingly different demands on the guide air flow.

Proceeding to block S6, a branch may be made either to a block S7 or a block S8, depending on the type of painting (detailed painting or surface painting).

In the case of detailed painting, a corresponding flag DL=1 is set in block S7.

In the case of surface painting, the flag DL is deleted in block S8, DL=0. The flag DL therefore states whether detailed painting or surface painting is to be carried out, so the flag DL is then stored for subsequent inclusion in the dynamic adaptation of the operating variables (e.g. rotational speed, guide air flow, paint flow, high voltage) of the rotary atomizer.

In a next block S9, it is then determined whether the painting is to take place with an electrostatic coating agent charging or without an electrostatic coating agent charging. This difference is important because, with an electrostatic coating agent charging, a minimum distance must be maintained from the earthed body part in order to avoid electrical flashovers. If however no electrostatic coating agent charging takes place, there is no risk of electrical flashovers, so there are no restrictions on the positioning of the rotary atomizer in this respect.

In a block S10, a branch is then made either to a block S10 or a block S11 depending on the activation or deactivation of the electrostatic (ESTA: electrostatic) coating agent charging.

In the case of electrostatic coating agent charging, a corresponding flag HS=1 is set in block S10.

If however no electrostatic coating agent charging is provided, the flag HS is deleted in block S11, HS=0. The flag HS therefore states whether electrostatic coating agent charging is to be carried out during the painting operation, so the flag HS is then stored for subsequent inclusion in the dynamic adaptation of the operating variables (e.g. rotational speed, high voltage, guide air flow, paint flow) of the rotary atomizer.

The flags IL, DL and HS are therefore status variables which reproduce the current status of the painting installation, it being possible for these status variables to be taken for example from the installation control system of the painting installation.

In a block S12, the desired spray jet width SB is then determined, which is likewise preprogrammed and therefore can generally simple be read out of the associated program memory which controls the painting process. The spray jet width SB is the width of a painting path on the component surface, within which the layer thickness is at least 50% of the maximum layer thickness.

In a further block S13, a geometric factor GF is then determined as a status variable, which reproduces the component geometry at the paint impact point. When painting essentially flat component surfaces, there are different demands on the operating variables (e.g. guide air flow, paint flow, high voltage, rotational speed) of the rotary atomizer than when painting highly curved component surfaces. The geometric factor GF can for example be derived from the stored CAD model (CAD: Computer Aided Design) of the motor vehicle body part to be painted in the installation control system, so no measurements are necessary to determine the geometric factor.

Proceeding to block S14, the distance A between the paint impact point on the component to be painted on the one hand and the electrical earthing point of the component on the other hand is then determined, the component being electrically earthed at the earthing point. If there is electrostatic coating agent charging, the electrical current is thus discharged towards the earthing point via the wet paint, so at each different paint impact point the insulation or the proximity to the earthing point should be taken into account in order to achieve an optimum painting result.

Furthermore, in a further block S15, the tracking speed v of the painting robot is determined, the tracking speed v being the speed at which the painting robot moves the rotary atomizer over the component surface during painting. At a low tracking speed v, only a relatively small paint flow is necessary, whereas the paint flow must be increased correspondingly with increasing tracking speed v in order to achieve a uniform layer thickness.

In a further block S16, it is then determined whether the component to be painted is a plastic component or a metal component, so that this difference can also be taken into account in the dynamic adaptation of the operating variables (e.g. rotational speed, high voltage, paint flow, guide air flow).

In a block S17 a branch is made either to a block S18 or a block S19, depending on the type of component to be painted (plastic component or metal component).

In the case of a metal component, a corresponding flag MA=1 is set in block S18 to indicate that the component to be painted is a metal component.

In the case of a plastic component, the flag MA is deleted in block S19, MA=0.

It is then determined in block S20 whether the rotary atomizer should be cleaned or whether the rotary atomizer is applying paint in a normal painting operation.

In a block S21 a branch is made either to a block S22 or a block S23, depending on the type of operation (cleaning or application). In the case of cleaning, a corresponding flag RB=1 is set in block S22. In the case of normal application, the flag RB is deleted in block S23, RB=0.

FIGS. 1A and 1B explained above therefore show the determination of status variables of the painting installation, which should be taken into account in the dynamic adaptation of the operating variables (e.g. rotational speed, high voltage, paint flow, guide air flow) of the rotary atomizer in order to achieve an optimal painting result.

FIG. 1C with block S24-S28, however, shows how the operating variables (e.g. rotational speed, high voltage, guide air flow, paint flow) of the rotary atomizer may be dynamically adapted depending on the previously determined status variables (e.g. geometric factor GF, spray jet width SB etc.).

In block S24, the paint flow QPAINT is thus defined according to a predefined function f1 depending on the previously determined status variables IL, DL, HS, A, MA, RB, v, GF and SB. The function f1 can in this case be stored in the form of a characteristic diagram in the installation control system.

In block S25, the guide air flow QGUIDE AIR is defined according to a function f2 depending on the status variables IL, DL, HS, A, MA, RB, v, GF and SB, it also being possible for the function f2 to be stored in the form of a characteristic diagram in the installation control system.

In block S26, the high voltage U for the electrostatic coating agent charging is then defined in a similar manner according to a function f3 depending on the previously determined status variables IL, DL, HS, A, MA, RB, v, GF and SB. The function f3 can also be stored in the form of a characteristic diagram in the installation control system.

In block S27, the rotational speed n of the rotary atomizer is then defined according to a function f4 depending on the previously determined status variables IL, DL, HS, A, MA, RB, v, GF and SB.

In block S28, the rotary atomizer is then actuated with the electrical and kinematic operating variables U and n and with the fluidic operating variables QPAINT and QGUIDE AIR.

The above-described process(es) shown in FIGS. 1A-1C may be repeated continuously during the movement of the rotary atomizer in continuous painting operation, so the operating variables U, n, QPAINT and QGUIDE AIR of the rotary atomizer are continuously adapted dynamically during the movement of the rotary atomizer in order to achieve an optimal painting result.

Figure 2:
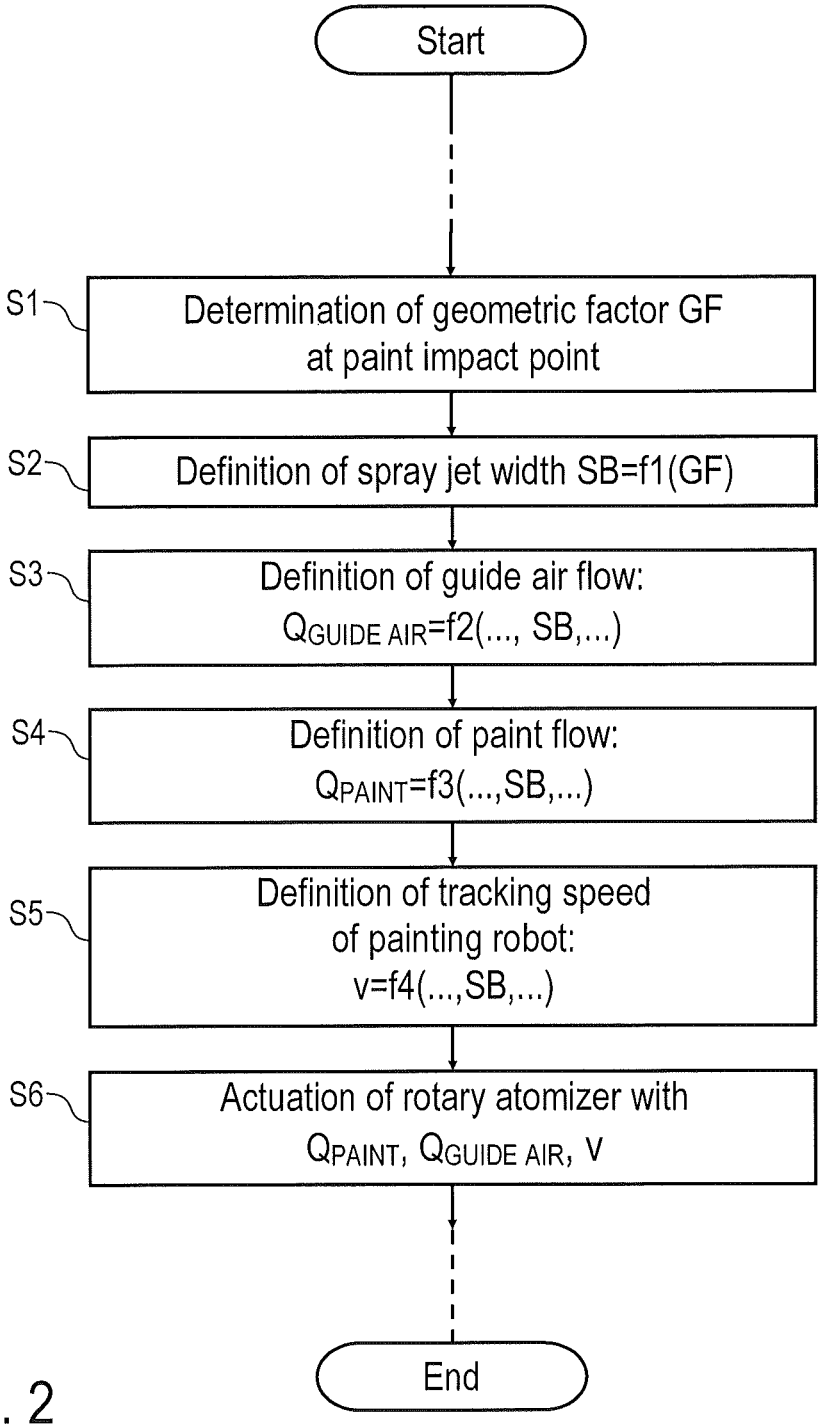
FIG. 2 illustrates an exemplary illustration of automatic parameter adaptation in the form of a flow chart.

FIG. 2 shows a first example of automatic parameter adaptation using software.

In a first block S1, a geometric factor GF is determined, which reproduces the component geometry at the paint impact point.

In a next block S2, the spray jet width SB is then defined according to a predefined function f1 depending on the geometric factor GF. In the case of a highly curved component geometry, a correspondingly greatly constricted spray jet with a correspondingly small spray jet width SB is desirable. When painting an essentially flat component surface, however, a spread out spray jet with a correspondingly large spray jet width SB is desirable.

In a next block S3 the guide air flow QGUIDE AIR is defined depending on the desired spray jet width SB according to a predefined function f2, it being possible for further status variables to be taken into account in addition to the desired spray jet width SB, which is only shown schematically here.

In a further block S4 the paint flow QPAINT is defined depending on the desired spray jet width SB according to a predefined function f3. If the spray jet width SB is large, a correspondingly large paint flow QPAINT is necessary to achieve the desired layer thickness.

The next block S5 then provides for the tracking speed v of the painting robot to be defined depending on the desired spray jet width SB according to a predefined function f4.

In a block S6, the rotary atomizer is actuated with the operating variables QPAINT, QGUIDE AIR determined in this manner, and the painting robot is moved over the component surface at the optimised tracking speed v.

In this example, the geometric factor GF is therefore determined in order to derive the optimal spray jet width SB therefrom. The definition of the spray jet width SB then leads to a corresponding adaptation of the guide air flow QGUIDE AIR, of the paint flow QPAINT and the tracking speed v. This automatic adaptation of parameters is repeated continuously during the movement of the rotary atomizer during operation of the painting robot, so the operating variables are adapted dynamically to the geometry of the component at the paint impact point.

Figure 3:
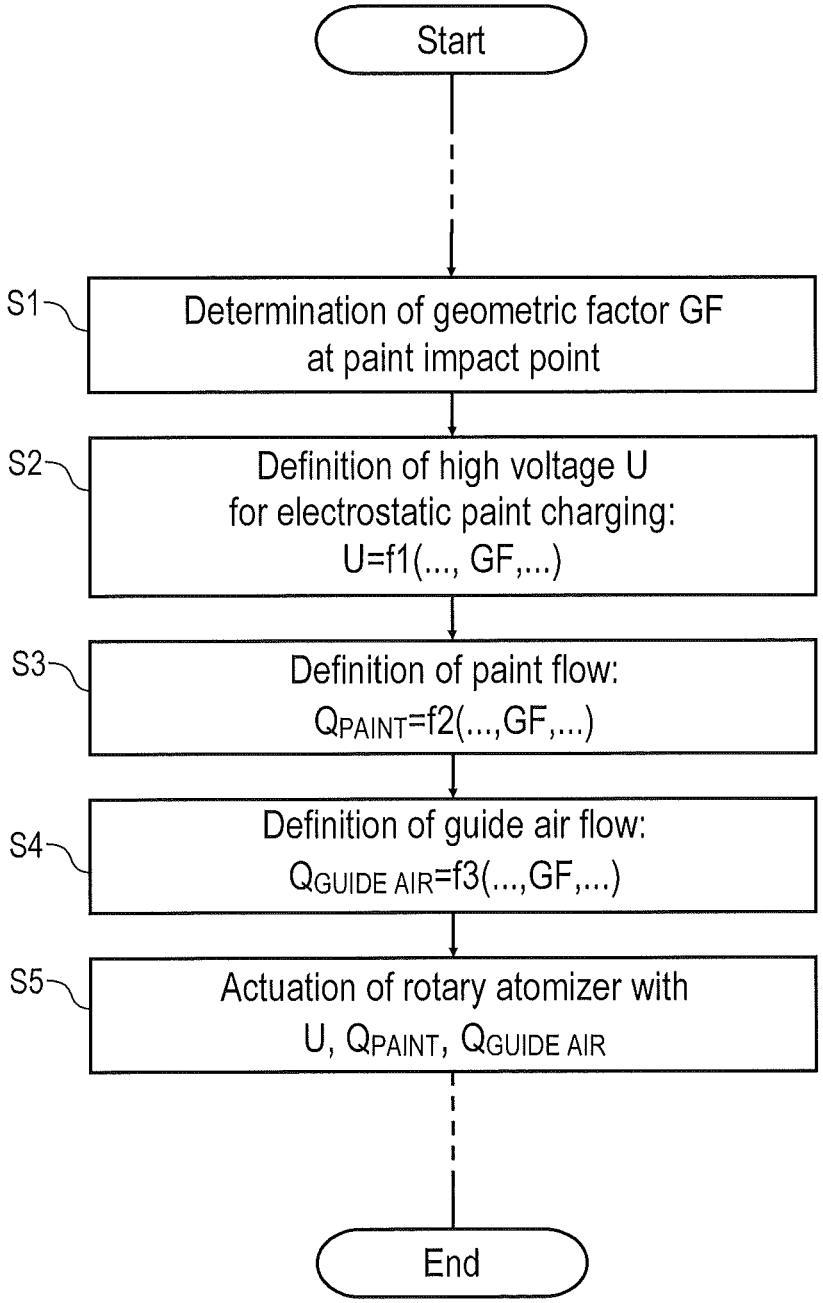
FIG. 3 illustrates another exemplary illustration of automatic parameter adaptation in the form of a flow chart.

FIG. 3 shows a second example of an automatic adaptation of parameters during painting, the processes, e.g., as described in blocks S1-S5 shown in FIG. 3, being repeated continuously during the movement of the rotary atomizer in continuous painting operation in order to make dynamic adaptation of the operating variables of the rotary atomizer possible.

In a first block S1, a geometric factor GF which reproduces the component geometry at the paint impact point is again determined.

In block S2, the high voltage U for the electrostatic paint charge is then defined depending on the geometric factor GF according to a predefined function f1.

Furthermore, in a block S3, the paint flow QPAINT is then defined depending on the geometric factor GF according to a predefined function f2.

Furthermore, in block S4, the paint flow QGUIDE AIR is then defined depending on the geometric factor GF according to a predefined function f3.

In block S5, the rotary atomizer is then actuated with the operating variables U, QPAINT and QGUIDE AIR adapted in this manner.

The above-described process(es) described in blocks S1-S5, may be continuously repeated during the movement of the rotary atomizer during continuous operation of the painting installation in order to adapt the operating variables U, QPAINT and QGUIDE AIR dynamically to the component geometry during the movement of the rotary atomizer in order to achieve an optimal painting result.

Figure 4:
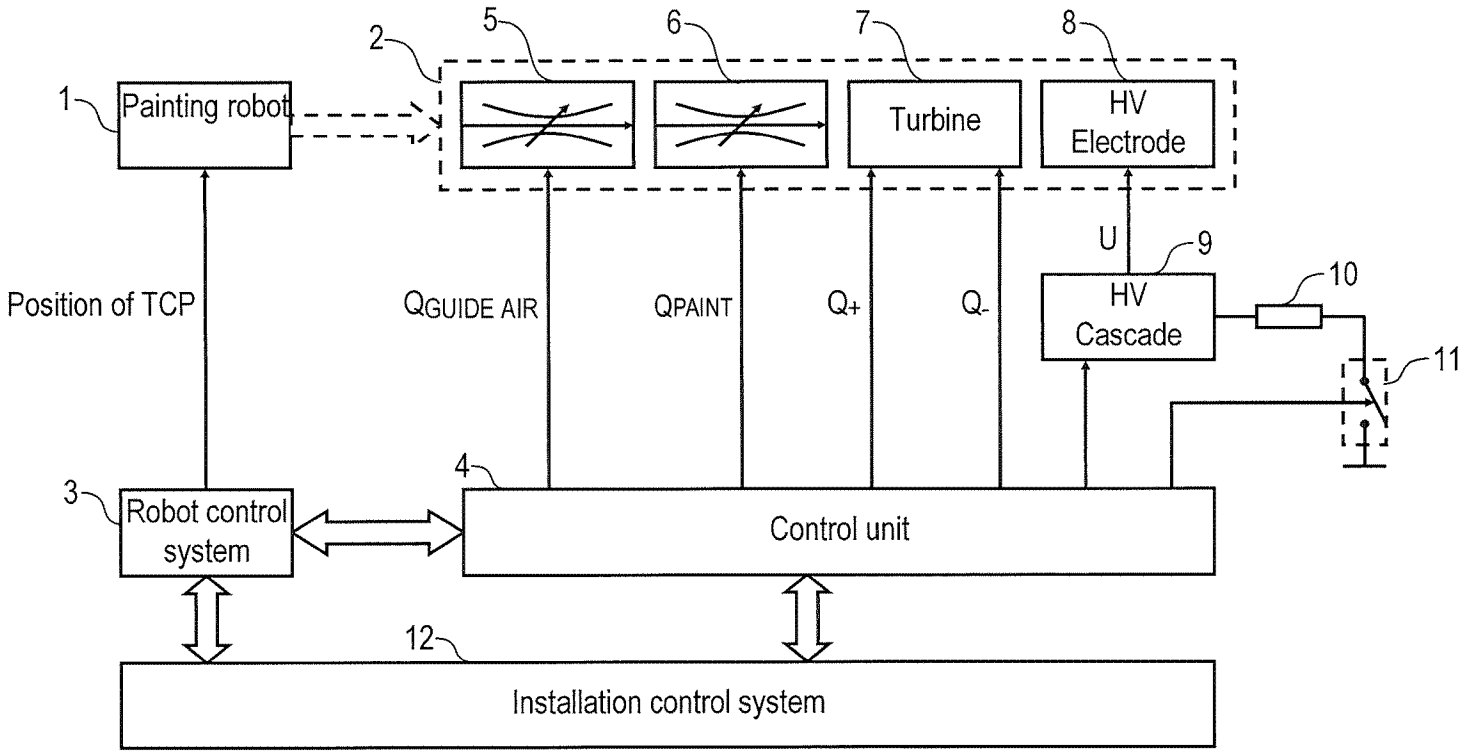
FIG. 4 illustrates a highly simplified diagram of an exemplary painting installation.

FIG. 4 shows, in a greatly simplified manner, a painting installation according to an exemplary illustration, having a multi-axis painting robot 1, which guides an electrostatic rotary atomizer 2 as the application unit, as is indicated by the dashed block arrow.

The painting robot is in this case controlled by a robot control system 3, the robot control system 3 predefining the position of the tool centre point (TCP) of the painting robot 1 and thereby moving the rotary atomizer 2 on predefined, programmed painting paths.

The rotary atomizer 2 is however actuated by a control unit 4 as described below.

The rotary atomizer 2 has for example a guide air valve 5, which is actuated by the control unit 4 so the control unit 4 sets the guide air flow QGUIDE AIR, which is output by the rotary atomizer 2 to form the spray jet.

Furthermore, the rotary atomizer has a paint valve 6, which is actuated by the control unit 4, so the control unit 4 controls the paint flow QPAINT which is output by the rotary atomizer 2 by means of suitable actuation of the paint valve 6.

Furthermore, the rotary atomizer 2 has a pneumatic turbine 7, which drives a bell cup of the rotary atomizer 2. A special feature of the turbine 7 consists in that the turbine 7 can be accelerated and braked in a pneumatically active manner in order to make a high level of rotational speed dynamics possible. To this end, the control unit 4 can set an acceleration air flow Q+ and a braking air flow Q− in order to set the desired rotational speed of the rotary atomizer 2. Reference should also be made in this respect to EP 1 245 292 B1, which has already been mentioned above.

The rotary atomizer 2 furthermore has a high-voltage electrode 8 to charge the applied coating agent electrostatically, which results in a high level of application efficiency. The high-voltage electrode 8 can be an internal electrode or an external electrode, as required, and is supplied with a certain high voltage U by a high-voltage cascade 9, the high-voltage cascade 9 likewise being actuated by the control unit 4 to achieve the desired high voltage U.

Furthermore, the high-voltage cascade is connected to earth via a bleeder resistor 10 and a bleeder switch 11 in order to be able to reduce the high voltage U quickly. The bleeder switch 11 is likewise actuated by the control unit 4 so that the high voltage U can be reduced rapidly if this is desirable as part of the dynamic adaptation of parameters. The high-voltage cascade can however in particular be controllable with photodiodes provided for the purpose, as has already been explained above.

The painting installation 12 also has an installation control system 12, which communicates bidirectionally with the robot control system 3 and the control unit and for example sends status variables of the painting installation to the control unit 4, so that the control unit 4 can take these status variables into account in the dynamic adaptation of the guide air flow QGUIDE AIR, of the paint flow QPAINT, of the acceleration air Q+, of the braking air Q− and of the high voltage U.

The exemplary illustrations are not limited to the previously described examples. Rather, a plurality of variants and modifications are possible, which also make use of the ideas of the exemplary illustrations and therefore fall within the protective scope. Furthermore the exemplary illustrations also include other useful features, e.g., as described in the subject-matter of the dependent claims independently of the features of the other claims.

Reference in the specification to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain examples, and should in no way be construed so as to limit the claimed invention.

Accordingly, it is to be understood that the above description is intended to be illustrative and not restrictive. Many examples and applications other than those specifically provided would be evident upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary is made herein. In particular, use of the singular articles such as "a," "the," "the," etc. should be read to recite one or more of the indicated elements unless a claim recites an explicit limitation to the contrary.

LIST OF REFERENCE NUMERALS

1 Painting robot
2 Rotary atomizer
3 Robot control
4 Control unit
5 Guide air valve
6 Paint valve
7 Turbine
8 High-voltage electrode
9 High-voltage cascade
10 Bleeder resistor
11 Bleeder switch
12 Installation control

The invention claimed is:

1. A coating installation for coating a component surface of a component with a coating agent, comprising:

an atomizer configured to apply the coating agent onto the component surface, a coating robot configured to move the atomizer over the component surface, and a control unit programmed to control operation of the atomizer according to electro/kinematic operating variables including a voltage for electrostatic charging of the coating agent, wherein the control unit is programmed to modify the electro/kinematic operating variables dynamically during operation of the atomizer as the atomizer moves relative to at least one path point defined by the component surface, and a bleeder switch electrically connected to the control unit, wherein modifying the electro/kinematic operation variables includes the control unit actuating the bleeder switch to reduce the voltage.

2. The coating installation according to claim 1, wherein the coating installation is adapted for painting a motor vehicle body part with a paint.

3. The coating installation according to claim 1, wherein:

the control unit is programmed to actuate the atomizer with fluidic operating variables, wherein the fluidic operating variables represent at least one of a coating agent flow and a guide air flow, and the control unit is programmed to modify the fluidic operating variables of the atomizer dynamically during the movement of the atomizer.

4. The coating installation according to claim 1, wherein:

the control unit is programmed to determine at least one status variable of the coating installation, and the control unit is programmed to dynamically adapt at least one of the electro/kinematic operating variable and fluidic operating variables of the atomizer during the movement of the atomizer depending on the determined at least one status variable of the coating installation.

5. The coating installation according to claim 4, wherein the at least one status variable of the coating installation indicates whether painting is taking place with or without electrostatic charging of the coating agent.

6. The coating installation according to claim 4, wherein the at least one status variable of the coating installation indicates whether internal painting or external painting of the component is taking place.

7. The coating installation according to claim 4, wherein the at least one status variable of the coating installation reproduces a geometry of the component at an impact point of the coating agent.

8. The coating installation according to claim 4, wherein the at least one status variable of the coating installation reproduces a distance between an impact point of the coating agent and an electrical grounding point at which the component is electrically grounded.

9. The coating installation according to claim 4, wherein the at least one status variable of the coating installation indicates whether the component in question is a plastic component or a component consisting of an electrically conductive material.

10. The coating installation according to claim 4, wherein the at least one status variable of the coating installation indicates whether detailed painting or surface painting is taking place.

11. The coating installation according to claim 4, wherein the at least one status variable of the coating installation indicates whether the atomizer is being cleaned or whether the atomizer is applying the coating agent.

12. The coating installation according to claim 1, wherein the control unit is programmed to determine a geometric factor of the component surface at a paint impact point at which the coating agent impacts the component surface, wherein the geometric factor reproduces a shape of the component surface at the paint impact point, the control unit is programmed to dynamically adapt a desired spray jet width depending on the geometric factor, the control unit is programmed to dynamically adapt at least one operating variable of the atomizer depending on the spray jet width or geometric factor, the at least one operating variable including at least one of:

paint flow, guide air flow, painting speed at which the atomizer is moved over the component surface.

13. The coating installation according to claim 1, wherein:

the control unit is programmed to determine a geometric factor of the component surface at a paint impact point at which the coating agent impacts the component surface, wherein the geometric factor reproduces a shape of the component surface at the paint impact point, and the control unit is programmed to dynamically adapt the voltage for the electrostatic charging of the coating agent depending on the geometric factor, and the control unit is programmed to dynamically adapt a paint flow depending on the geometric factor, and the control unit is programmed to dynamically adapt a guide air flow depending on the geometric factor.

14. The coating installation according to claim 1, wherein at least one of the electro/kinematic operating variable and a fluidic operating variable of the atomizer have a setting time during a change in setpoint value of less than 2 s, wherein at least 95% of the change in setpoint value is implemented within the setting time.

15. The coating installation according to claim 1, further comprising:

a high-voltage cascade for generating the high voltage for the electrostatic charging of the coating agent, a bleeder resistor electrically connected to the bleeder switch and to the high-voltage cascade, wherein the control unit actuating the bleeder switch diverts electrical charge away from the high-voltage cascade and toward the bleeder resistor to reduce the voltage.

16. The coating installation according to claim 1, further comprising a coating agent configured to hold a charge with an electrical capacitance less than 2 nF.

17. The coating installation according to claim 1, the atomizer is configured to be driven by an electric motor.

18. The coating installation according to claim 17, wherein at least a portion of the atomizer is electrically isolated to allow electrostatic charging of the coating agent.

19. The coating installation according to claim 1, further comprising a turbine configured for pneumatically driving the atomizer, wherein the turbine is configured to be accelerated and braked by means of compressed air.

* * * * *